US010196189B2

(12) United States Patent
Scott et al.

(10) Patent No.: US 10,196,189 B2
(45) Date of Patent: Feb. 5, 2019

(54) CARBONATED BEVERAGE CLOSURE

(71) Applicant: Zipz, Inc., Warren, NJ (US)

(72) Inventors: J. Henry Scott, Warren, NJ (US); Bruce T. Cleevely, Middletown, PA (US); Robert J. Early, Middletown, PA (US)

(73) Assignee: Zipz, Inc., Warren, NJ (US)

( * ) Notice: Subject to any disclaimer, the term of this patent is extended or adjusted under 35 U.S.C. 154(b) by 23 days.

(21) Appl. No.: 15/293,513

(22) Filed: Oct. 14, 2016

(65) Prior Publication Data

US 2017/0107026 A1 Apr. 20, 2017

Related U.S. Application Data

(60) Provisional application No. 62/242,430, filed on Oct. 16, 2015.

(51) Int. Cl.

| | |
|---|---|
| ***B65D 51/16*** | (2006.01) |
| ***B65D 43/02*** | (2006.01) |
| ***B65D 17/28*** | (2006.01) |

(52) U.S. Cl.

CPC ..... *B65D 51/1683* (2013.01); *B65D 17/4012* (2018.01); *B65D 43/0225* (2013.01); *B65D 2517/0013* (2013.01)

(58) Field of Classification Search

CPC ..... B65D 51/1683; B65D 51/1672; B65D 51/1633; B65D 51/16; B65D 17/401; B65D 17/4012; B65D 17/4014; B65D 43/00; B65D 43/02; B65D 43/0225; B65D 43/0214

USPC ..... 220/254.1

See application file for complete search history.

(56) References Cited

U.S. PATENT DOCUMENTS

| | | | | |
|---|---|---|---|---|
| 4,007,851 | A | 2/1977 | Walker | |
| 4,322,012 | A * | 3/1982 | Conti | B65D 41/3442 215/252 |
| 4,487,326 | A | 12/1984 | Uhlig | |
| 4,664,288 | A | 5/1987 | Pereira et al. | |
| 4,738,370 | A | 4/1988 | Urmston | |
| 4,756,438 | A | 7/1988 | Ryder | |

(Continued)

FOREIGN PATENT DOCUMENTS

| | | |
|---|---|---|
| EP | 0070162 A2 | 1/1983 |
| GB | 1393875 | 5/1975 |

(Continued)

OTHER PUBLICATIONS

Thomas Scientific, Threaded Vented Cap, http://www.thomassci.com/Supplies/Caps/_/THREADED-VENTED-CAP?q=Vent%20Cap, retrieved on Jan. 30, 2015, pp. 1-2.

(Continued)

*Primary Examiner* — Steven A. Reynolds
*Assistant Examiner* — Javier A Pagan
(74) *Attorney, Agent, or Firm* — Chiesa Shahinian & Giantomasi PC

(57) ABSTRACT

A threaded closure comprises a vent assembly that can be actuated to release pressure from a container on which the closure is located. The vent assembly is made from a flexible material that allows a vent to be uncovered by tearing the material. In one embodiment, the vent assembly allows pressure to be released form a container prior to removal of the closure.

19 Claims, 9 Drawing Sheets

(56) References Cited

U.S. PATENT DOCUMENTS

| | | | | |
|---|---|---|---|---|
| 5,915,585 | A | 6/1999 | Ladina et al. | |
| 6,041,982 | A | 3/2000 | Cautereels et al. | |
| 6,053,474 | A | 4/2000 | Stucke et al. | |
| 6,227,391 | B1 | 5/2001 | King | |
| 6,877,625 | B2 | 4/2005 | Alley | |
| 7,575,121 | B2 * | 8/2009 | Ooka | B65D 41/325 215/344 |
| 7,946,443 | B2 | 5/2011 | Stull | |
| 8,777,030 | B2 | 7/2014 | Ziegenhorn et al. | |
| 8,794,461 | B2 | 8/2014 | Major | |
| 8,807,360 | B2 | 8/2014 | Erspamer et al. | |

FOREIGN PATENT DOCUMENTS

| | | | |
|---|---|---|---|
| WO | 9420384 | A1 | 9/1994 |
| WO | 9739955 | A1 | 10/1997 |
| WO | 9926855 | | 6/1999 |

OTHER PUBLICATIONS

MOCAP, Tear Tab Plastic Caps for NPT Threads, http://www.mocap.com/caps-plastic-tear-npt.html, retrieved on Jan. 30, 2015, p. 1.

AliExpress, Non Spill Cap/Bottle Cap/ Water cap, hftp://www.aliexpress.com/item/non-spill-cap-bottle-cap-water-cap/309485528.hmtl, pp. 1-8.

International Search Report and Written Opinion dated Jan. 13, 2017, for corresponding international patent appln. No. PCT/US2016/057230, 16 pgs.

* cited by examiner

CARBONATED BEVERAGE CLOSURE

This application is a non-provisional application of U.S. Provisional Patent Application No. 62/242,430 filed Oct. 16, 2015, the disclosure of which is incorporated by reference herein in its entirety.

BACKGROUND

The present disclosure relates generally to beverage containers, and more particularly to a carbonated beverage closure.

Many beverages are carbonated either naturally or by dissolving carbon dioxide, typically under high pressure, in a liquid. Carbon dioxide is soluble in a liquid and separates into a gas when pressure is released. Carbonated beverages produce pressure in a closed volume. This pressure is exerted on the inner surface of a container in which the carbonated beverage is stored. This pressure is typically released when the container the beverage is stored in is opened. The carbon dioxide in the liquid separates into a gas when the container is opened which causes the solution to become effervescent.

The internal surface of closures for carbonated beverage containers is exposed to the pressure contained in the beverage container. As such, the force exerted on the inner surface is equal to the pressure times the area of the internal surface. Opening a carbonated beverage container can result in spillage of the fluid container therein.

SUMMARY

In one embodiment, a threaded closure comprises a vent assembly that can be actuated to release pressure from a container on which the closure is located. In one embodiment, the vent assembly is made from a flexible material that allows a vent to be uncovered by tearing the material. In one embodiment, the vent assembly allows pressure to be released from a container prior to removal of the closure.

In one embodiment, a closure comprises a cap and a vent assembly. The cap comprises a circular top having a first opening and a second opening. In one embodiment, the first opening is located in substantially a center of the circular top and the second opening is offset from the first opening. The cap also comprises a cylindrical sidewall extending downward from a periphery of the circular top. The sidewall can comprise threads located on an inner surface of the sidewall configured to engage complimentary threads of a beverage container. The threads can have a low angle pitch and be made from a material sufficiently rigid so that the threads can withstand pressure generated from a carbonated beverage located in the beverage container. The vent assembly comprises a top portion located on a top surface of the circular top and a bottom portion located on a bottom surface of the circular top. A hollow connector located in the first opening connects the first portion to the second portion. A solid connector located in the second opening connects the first portion to the second portion. In one embodiment, the top portion of the vent assembly is elongated and has a circular end opposite an end of the top portion located over the second opening.

In one embodiment, a circular seal is located on the bottom surface of the circular top. The circular seal and the vent assembly can be made of a flexible material that is over molded onto the cap. The vent assembly, in one embodiment, is made of a material that is sufficiently rigid to withstand pressure generated from a carbonated beverage located in the beverage container.

DETAILED DESCRIPTION

A carbonated liquid in a sealed container exerts pressure on an inner surface of the sealed container. The force exerted on the inner surface is equal to the pressure times the area of the surface. As such, a closure having a large surface area exposed to a specific pressure will have a force acting on it that is higher than a closure having a smaller surface area exposed to the specific pressure. For example, a closure for an upper opening of a beverage container designed to function like a drinking glass, such as a champagne flute, will have a higher force exerted on it than a cap for a bottle shaped container with a smaller upper opening covered by the cap.

In order to prevent a large diameter cap, such as a cap for a drinking glass or a champagne flute, from being forced off of the top of an associated container, the closure and a complimentary portion of an upper lip of the container may be threaded. Such threads may be large and have a low angle screw to resist the force pushing the closure away from the beverage container. A lead and a pitch of the threads are selected to prevent the cap from being forced off of the top of an associated container. Different combinations of thread dimensions that prevent the cap from being forced off of the top of an associated container can be used.

Opening such a closure acted on by a large force is resisted by friction between engaged threads of the closure and the beverage container. This friction requires a large twisting or turning force to be applied to the cap in order to twist the cap off of the container. Further, when the threads of the container and the cap begin to disengage, the closure and the beverage container may rapidly separate due to the carbonation pressure inside beverage container overcoming the portion of threads remaining engaged between the cap and the container. This rapid separation can result in the cap and/or container being forcefully pushed apart. In addition, opening a carbonated beverage closure prior to release of pressure can result in spillage of the contents of the container.

A vent located on the closure of the container can be actuated to release pressure from the container allowing the closure to be removed from the container. In one embodiment, the release of pressure from the container prevents the content of the container from being forced from the container upon removal of the closure.

Figure 1A:
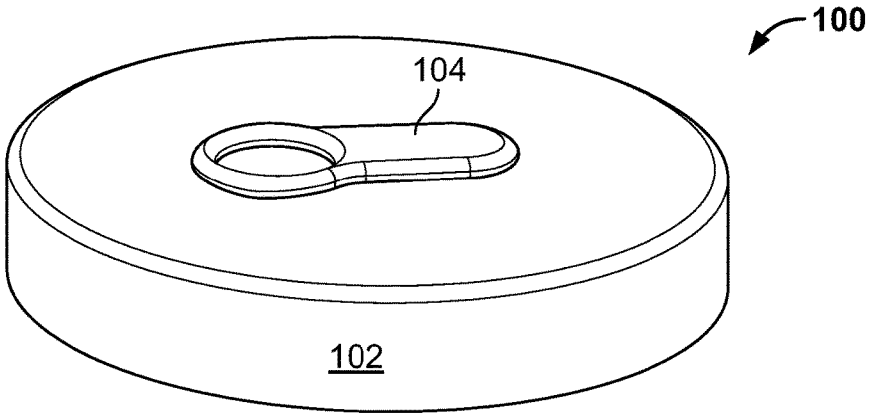
FIG. 1A depicts a perspective view of a closure according to one embodiment.
Figure 1B:
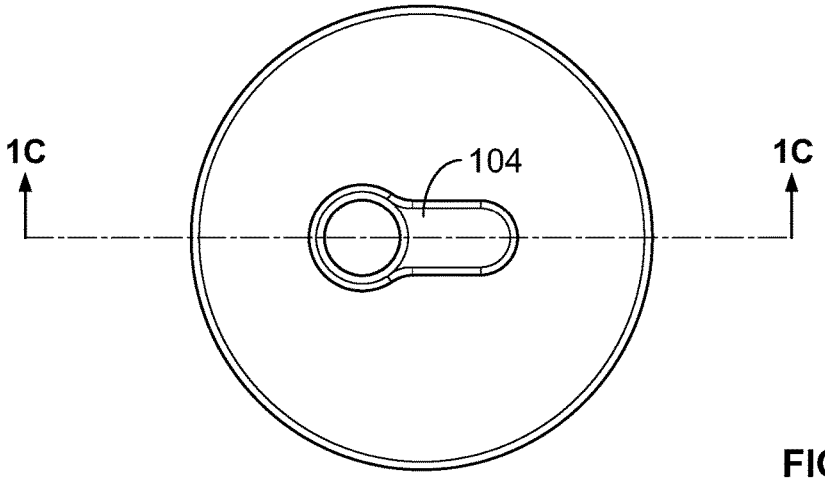
FIG. 1B depicts a top view of the closure of FIG. 1A.
Figure 1C:
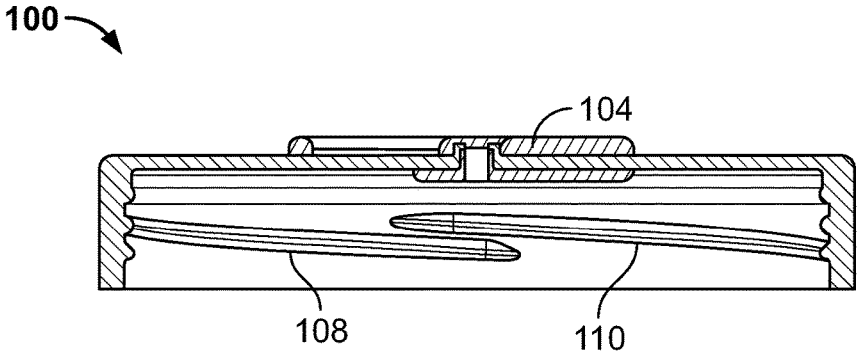
FIG. 1C depicts a section view of the closure of FIG. 1A.

In one embodiment, a vent is located on the cap of a carbonated beverage container to vent internal container pressure prior to removal of the cap from the container. FIG. 1 depicts closure 100 according to one embodiment. Closure 100 is shown having a cap 102 and vent assembly 104. Cap 102 is substantially cylindrical having a sidewall height approximately one-third of the radius of cap 102. FIG. 1B depicts a top view of cap 102 and FIG. 1C depicts a cross section view of cap 102. As shown in FIG. 1B, vent assembly 104 includes a circular opening on one end of an elongated cover. As shown in FIG. 1C, the inner periphery of cap 102 has multiple threads 108,110 configured to engage complimentary threads of a container (now shown).

Cap 102, in one embodiment, is made from a rigid plastic, such as polycarbonate, but can be made from other types of plastics or materials such as polyethylene terephthalate (PET), polypropylene, acrylic, etc. Cap 102 can be made of any material that is rigid enough to allow threads of the cap to engage complimentary threads of a container and withstand forces acting on the cap caused by pressure inside the container. Vent assembly 104, in one embodiment, is made from a plastic less rigid than the material cap 102. In one embodiment, vent assembly 104 is made of thermoplastic elastomer (TPE) but can be made from other materials such as linear low density polyethylene (LLDPE), etc. Vent assembly 104 can be from any material that is rigid and/or resilient enough to resist forces caused by pressure within a container to which the associated cap is attached. In one embodiment, the vent material should not bond to the cap. In one embodiment, the material of vent assembly 104 should also be fragile enough to allow material sealing an end of a vent orifice (described in detail below) to be torn away in order to allow venting of the container. In one embodiment, an underside of cap 102 has a rough surface to promote grip of vent assembly 104 to cap 102.

Figure 2A:
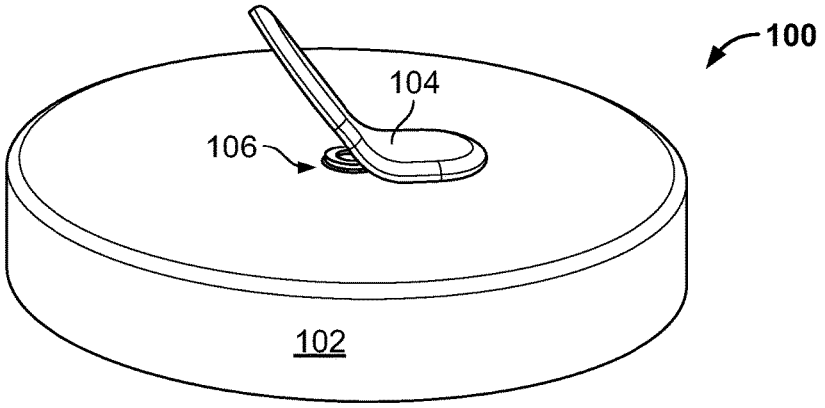
FIG. 2A depicts a perspective view of the closure of FIG. 1A with the pressure release vent opened.
Figure 2B:
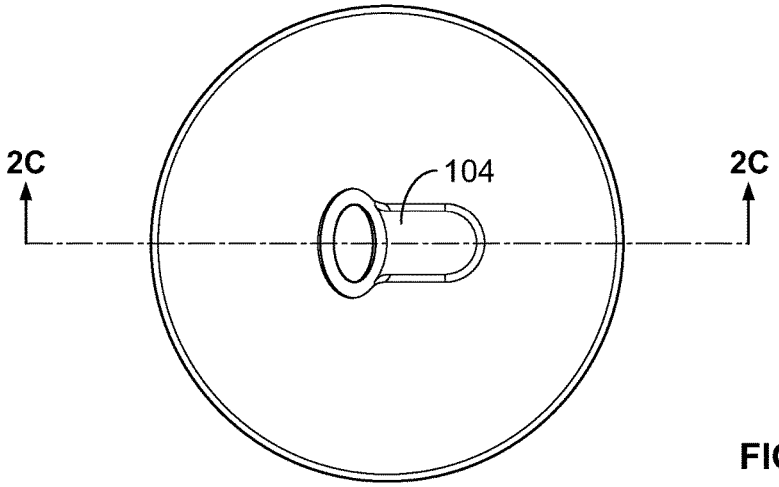
FIG. 2B depicts a top view of the closure of FIG. 2A.
Figure 2C:
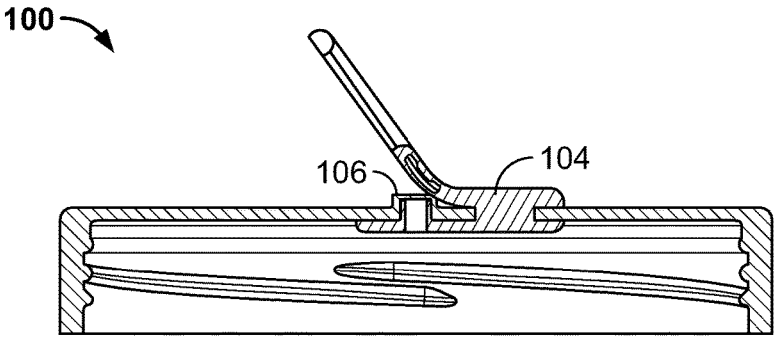
FIG. 2C depicts a cross section of the closure of FIG. 2A

FIG. 2A depicts a perspective view of cap 102 with vent assembly 104 actuated to vent pressure from a container through vent orifice 106. FIG. 2B depicts a top view of cap 102 with vent assembly 104 actuated. FIG. 2C depicts a cross section of cap 102 with vent assembly actuated to uncover vent orifice 106. Vent assembly 104 as shown in FIG. 1B is actuated by a person gripping the circular portion of vent assembly 104 and peeling the vent assembly away from the upper surface of cap 102 as shown in FIG. 2B. The circular portion of vent assembly 104 can be sized to allow a person's finger or fingertip to be inserted into the circular opening to promote gripping of the vent assembly.

Figure 3A:
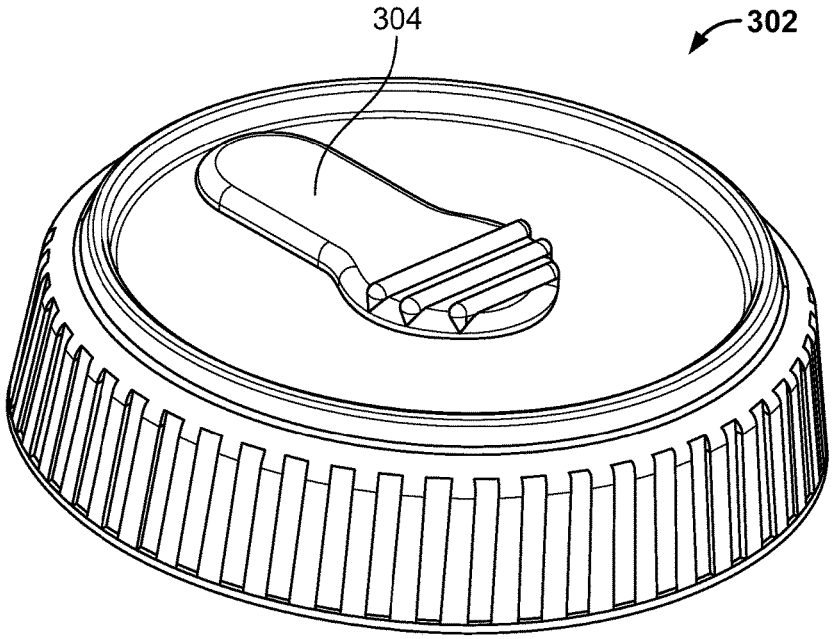
FIG. 3A depicts a top perspective view of a closure according to an alternative embodiment.
Figure 3B:
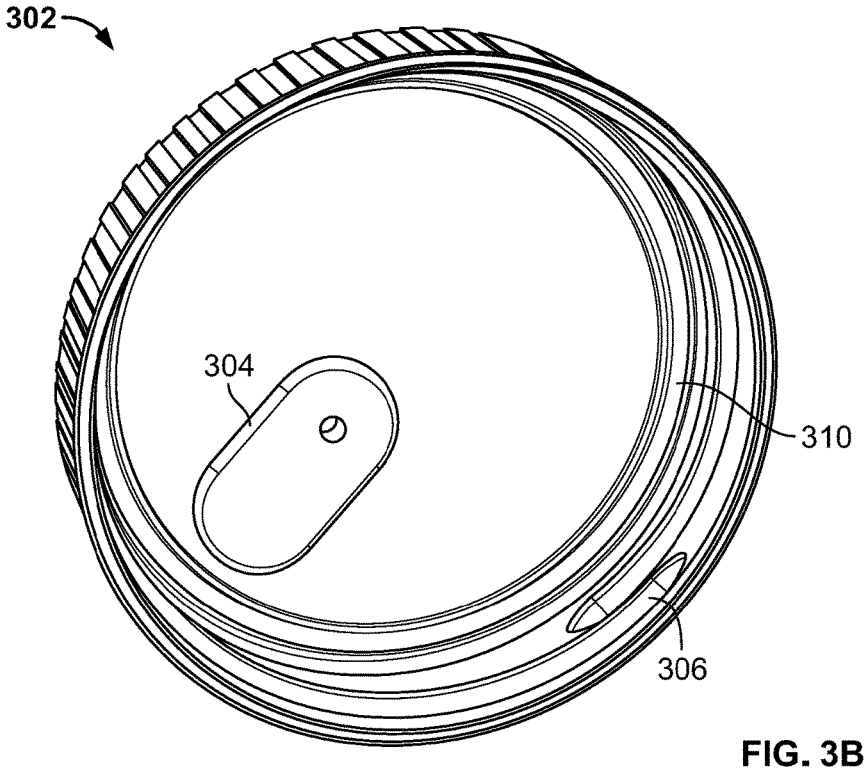
FIG. 3B depicts a bottom perspective view of the closure of FIG. 3A.

FIG. 3A depicts a cap 302 for a carbonated beverage container according to an embodiment. As shown in FIG. 3, cap 302 has ridges circumferentially spaced about its periphery. In one embodiment, the ridges facilitate gripping cap 302 for removal. Vent assembly 304, similar to vent assembly 104 of FIG. 1A, can be actuated to vent pressure from inside a container to which cap 302 is attached. Vent assembly 304 is shown having a circular portion on an end of an elongated cover. The circular portion, in this embodiment, has ridges to promote a user's grip of the circular portion. FIG. 3B depicts the underside of cap 302 and vent assembly 304. Cap 302 has threads 306 configured to engage complementary threads of a container (not shown). FIG. 3B also depicts seal 310 which is described in further detail in connection with FIG. 4F.

Figure 4A:
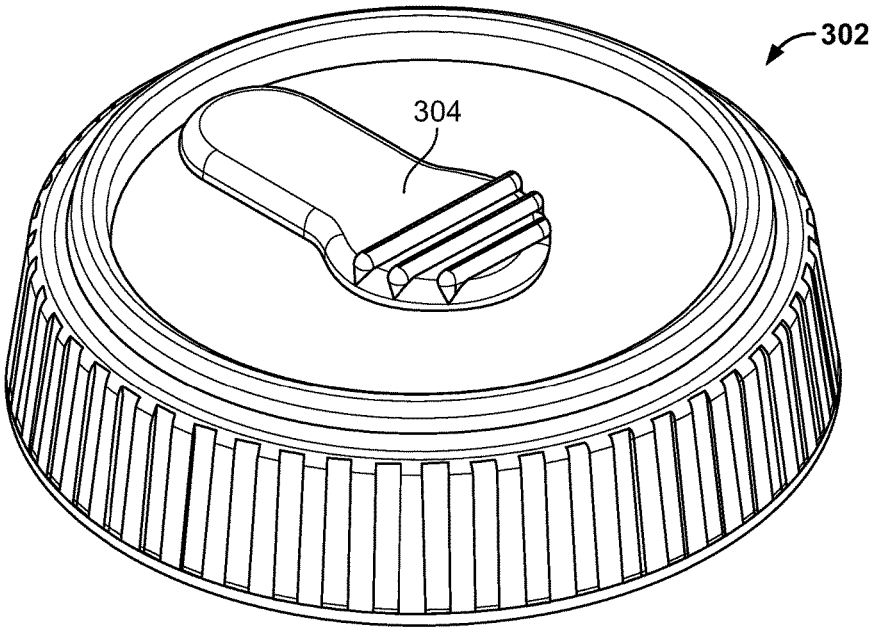
FIG. 4A depicts a top perspective view of the closure of FIG. 3A.
Figure 4B:
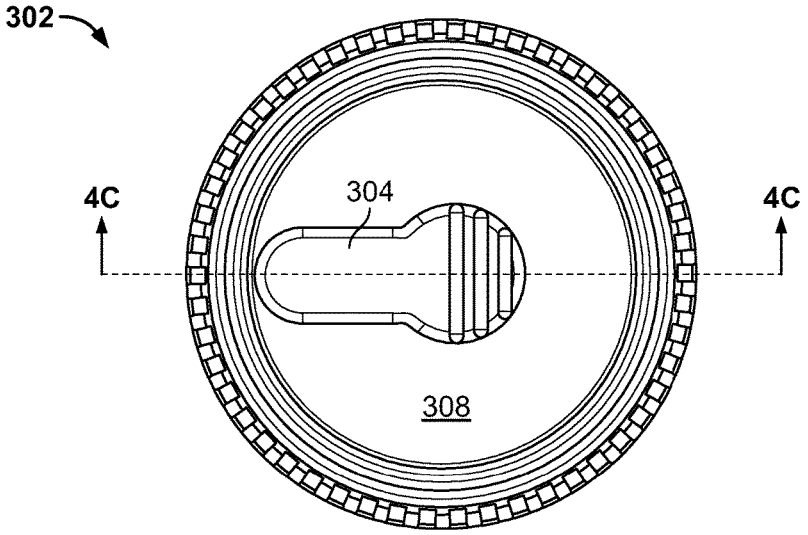
FIG. 4B depicts a top view of the closure of FIG. 3A.
Figure 4C:
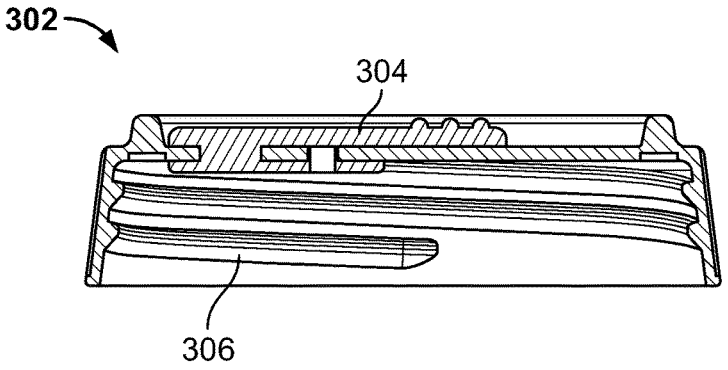
FIG. 4C depicts a cross section view of the closure of FIG. 3A.
Figure 4D:
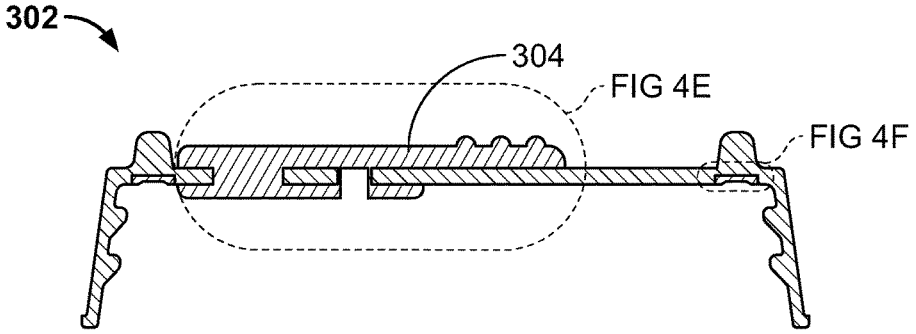
FIG. 4D depicts cross section view of the closure of FIG. 3A with a portion of the sidewall of the closure removed for clarity.

FIG. 4A depicts cap 302 with vent assembly 304 that can be actuated to release pressure from within the volume enclosed by cap 302 and a container (not shown) on which cap 302 is located. FIG. 4B depicts a top view of cap 302 having vent assembly 304. FIG. 4C depicts a cross section view of cap 302 and vent assembly 304. Threads 306 of cap 302 are configured to engage complimentary threads of a container (not shown). FIG. 4D depicts a cross section view of cap 302 with a portion of the sidewall omitted for clarity. FIG. 4D identifies two sections of cap 302 that are depicted in greater detail in FIGS. 4E and 4F.

Figure 4E:
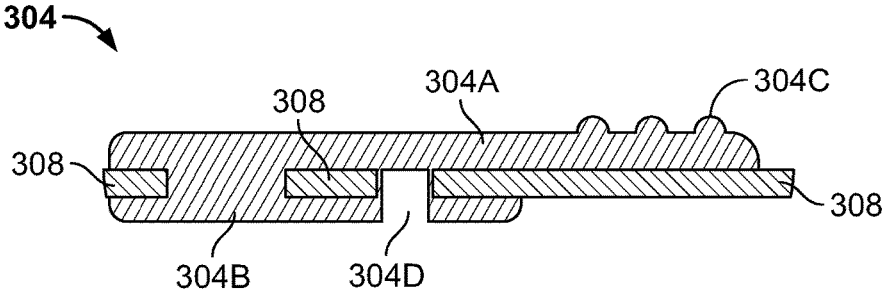
FIG. 4E depicts a detail of a vent assembly shown in FIG. 4D.

FIG. 4E depicts vent assembly 304 engaged with top portion 308 of cap 302. Vent assembly 304 is shown in FIG. 4E having an upper portion 304A including a plurality of ridges 304C which, in one embodiment, provide a gripping area to vent assembly 304. Plurality of ridges 304C facilitate a user grasping upper portion 304A to vent pressure inside a container (not shown) that cap 302 is engaged with (e.g., cap 302 threaded onto a container). Upper portion 304A is connected to lower portion 304B via a circular vent assembly retention opening in top portion 308 of cap 302. Upper portion 304A is also connected to lower portion 304B via a cylindrical portion of material located along the inner periphery of a vent opening in top portion 308 of cap 302. As shown in FIG. 4E, the cylindrical portion of material in the vent opening of top portion 308 is hollow. In other embodiments, the portion of material can be other shapes, such as rectangular, and can be solid.

In one embodiment, vent assembly 304 is made from a flexible material strong enough to retain upper portion 304A to lower portion 304B via vent assembly material connecting the two portions together through the vent assembly retention opening. The material of vent assembly 304 is also strong enough to prevent gases from escaping from inside a volume formed by cap 302 engaged with a container (not shown) prior to actuation of vent assembly 304.

Figure 4F:
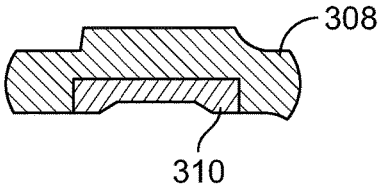
FIG. 4F depicts a detail of a seal shown in FIG. 4D.

FIG. 4F depicts top portion 308 of cap having a rectangular groove in which seal 310 is located. The rectangular groove is located so that seal 310 engages with an upper lip of a container when cap 302 is engaged with the container via threads 306 (shown in FIG. 4B). In one embodiment, seal 310 is over molded onto cap 302. Seal 310, in one embodiment, is made of TPE but can be made from other materials such as LLDPE, urethane, etc. Seal 310 can be made of any material that can be molded into or otherwise located in rectangular groove of cap 302 and is sufficiently resilient to promote sealing between cap 302 and a container on which cap 302 is located. In one embodiment, seal 310 is made of a material that is able to seal cap 302 to a container on which cap 302 is located in order to prevent pressure from escaping the volume enclosed by cap 302 and the container on which cap 302 is located. In one embodiment, the entire underside of cap 302 is over molded with the same material used for vent assembly 304 and seal 310. In such embodiments, seal 310 and vent assembly 304 are formed on cap 302 as a single contiguous piece of material. In one embodiment, seal 310 can be formed separately and then mechanically inserted into rectangular groove of cap 302. For example, seal 310 can be formed separately and then pushed into the rectangular groove of cap 302 and frictionally retained.

Figure 5A:
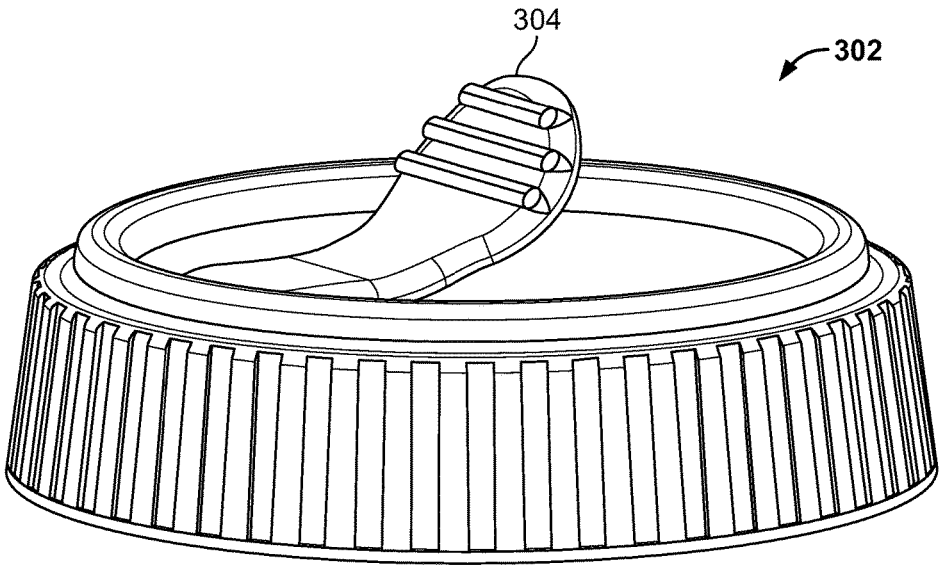
FIG. 5A depicts a top perspective view of the closure of FIG. 3A with the vent assembly actuated.
Figure 5B:
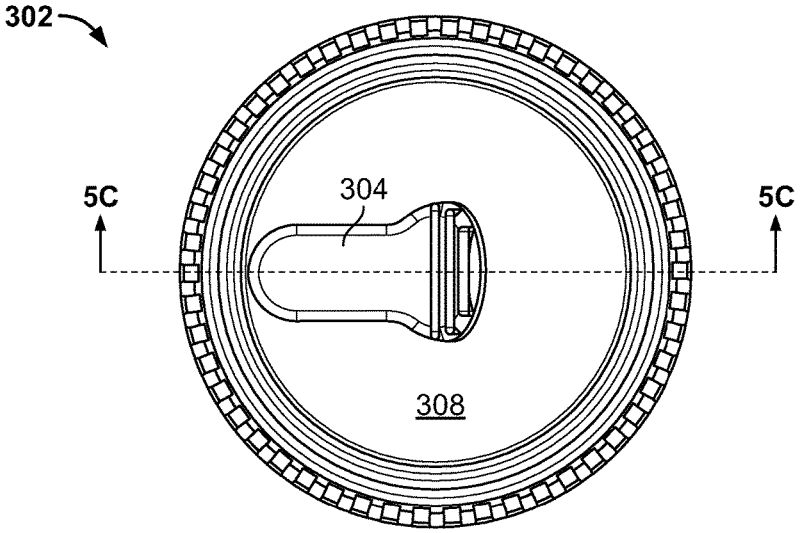
FIG. 5B depicts a top view of the closure of FIG. 5A.
Figure 5C:
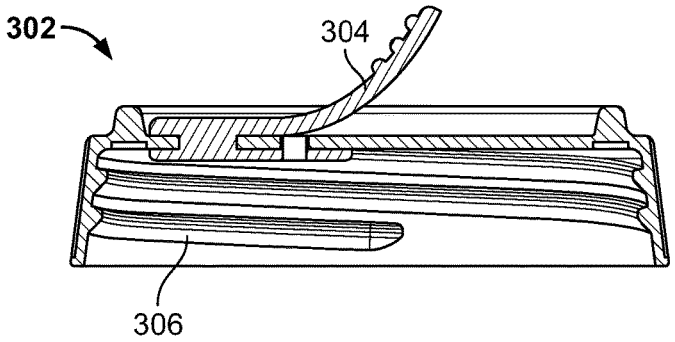
FIG. 5C depicts a cross section view of the closure of FIG. 5A.
Figure 5D:
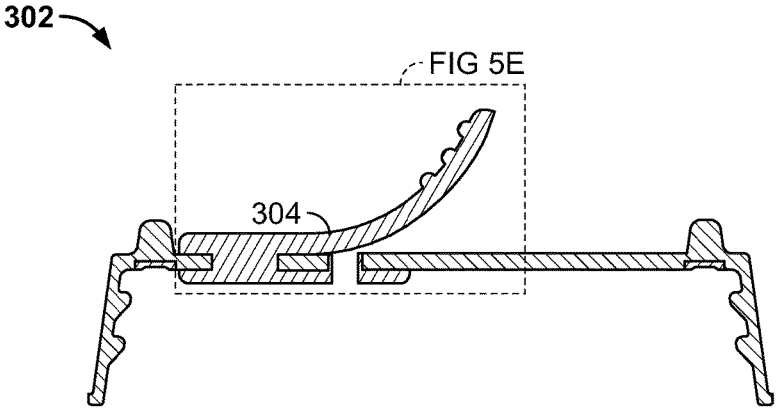
FIG. 5D depicts a cross section view of the closure of FIG. 5A with a portion of the sidewall of the closure removed for clarity.

FIG. 5A depicts cap 302 with vent assembly 304 actuated to release pressure from within the volume enclosed by cap 302 and a container (not shown) on which cap 302 is located. FIG. 5B depicts a top view of cap 302 with vent assembly 304 actuated. FIG. 5C depicts a cross section view of cap 302 and vent assembly 304. Threads 306 of cap 302 are configured to engage complimentary threads of a container (not shown). FIG. 5D depicts a cross section view of cap 302 with a portion of the sidewall omitted for clarity. FIG. 5D identifies a portion of cap 302 and vent assembly 304 depicted in FIG. 5E.

Figure 5E:
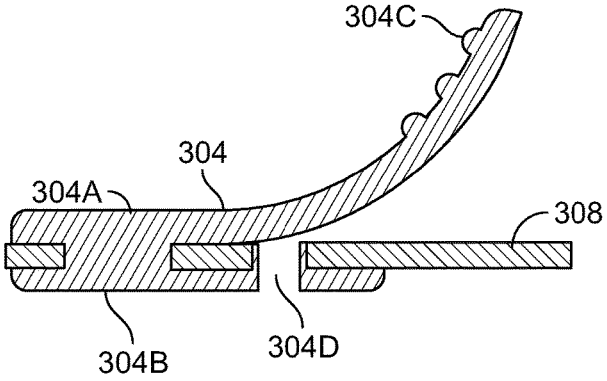
FIG. 5E depicts a detail of the vent assembly of the closure of FIG. 5A.

FIG. 5E depicts vent assembly 304 actuated to release pressure from within a volume enclosed by cap 302 and a container (not shown) on which cap 302 is located. As shown in FIG. 5E, upper portion 304A has been peeled away from an upper surface 308 of cap 302 in order to tear upper portion 304 from an upper portion of a cylindrical portion of the vent assembly located in a vent orifice of upper surface 308 of cap 302. Actuation (i.e., peeling upper portion 304A of vent assembly 304 away from upper surface 308 of cap 302) of vent assembly 304 allows pressure to be released from within a volume enclosed by cap 302 and a container (not shown) on which cap 302 is located (e.g. installed or screwed onto). Upper portion 304A and lower portion 304B of vent assembly 304 are connected via a portion of vent assembly material located in a vent retainer orifice located in upper surface 308 of cap 302. The connection between upper portion 304A and lower portion 304B causes vent assembly 304 to substantially maintain its position on cap 302 after actuation.

Figure 6A:
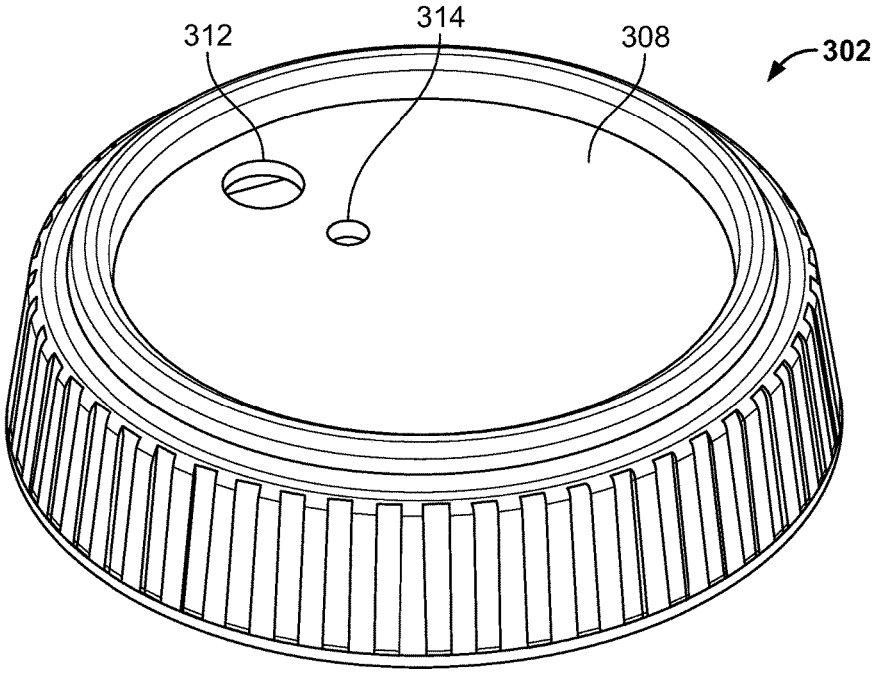
FIG. 6A depicts a top perspective view of a cap of the closure of FIG. 5A without the vent assembly molded in place.
Figure 6B:
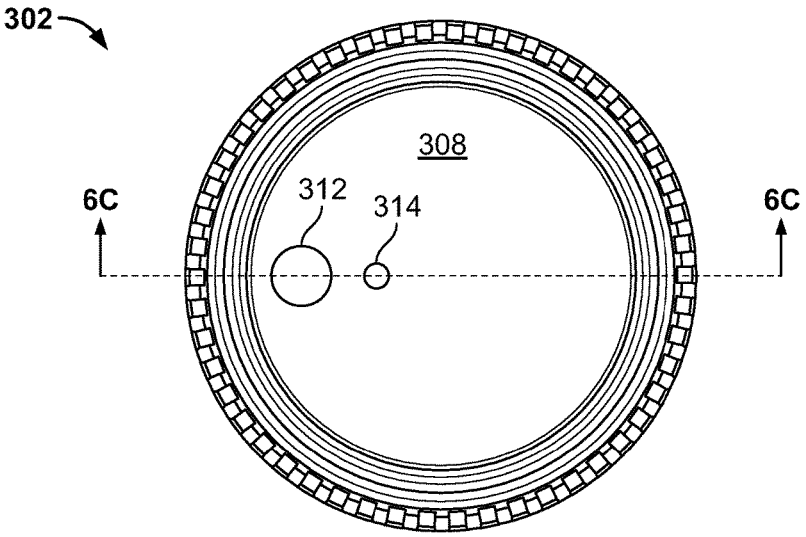
FIG. 6B depicts a top view of the cap of FIG. 6A.
Figure 6C:
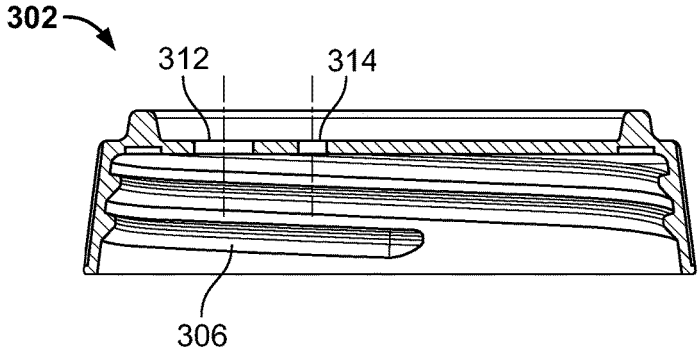
FIG. 6C depicts a cross section view of the cap of FIG. 6A.
Figure 6D:
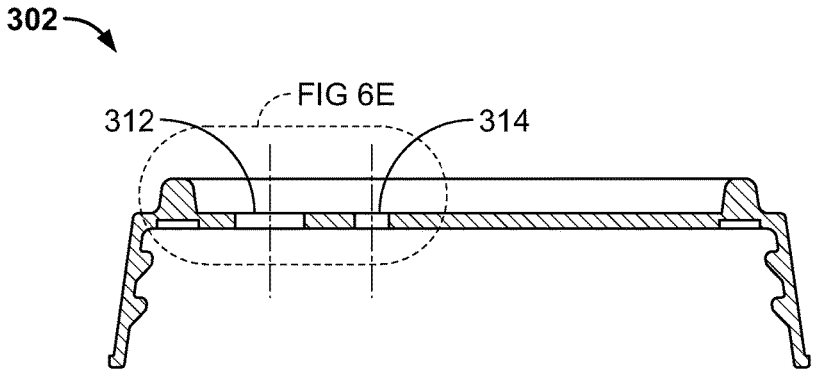
FIG. 6D depicts a cross section view of the cap of FIG. 6A with a portion of the sidewall of the cap removed for clarity.
Figure 6E:
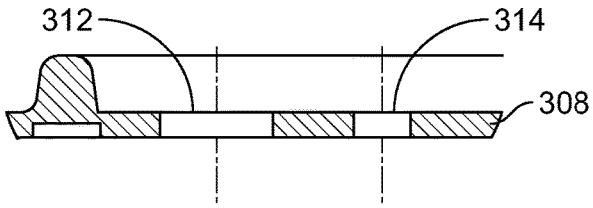
FIG. 6E depicts a detail of the cap of FIG. 6A.

FIG. 6A depicts cap 302 without vent assembly 304 shown in FIGS. 3-5. Upper surface 308 of cap 302 has vent retainer orifice 312 and vent orifice 314. Vent retainer orifice 312 provides a passage to connect upper portion 304A and lower portion 304B of vent assembly 304 via vent assembly material located in vent retainer orifice 312. Vent orifice 314 provides a passage through upper surface 308 of cap to allow pressure within a volume enclosed by cap 302 and a container (not shown) on which cap 302 is located. FIG. 6C depicts a cross section view of cap 302 having vent retainer orifice 312 and vent orifice 314 located offset from the center of upper surface 308 of cap 302 according to an embodiment. Vent retainer orifice 312 and vent orifice 314 can be located in other positions on upper surface 308. FIG. 6D depicts a cross section of cap 302 with a portion of the sidewall of the cap omitted for clarity. FIG. 6E depicts a detail of vent retainer orifice 312 and vent orifice 314 located in upper surface 308 of cap 302.

Vent assembly, in one embodiment, is over molded onto top portion 308 of cap 302. In one embodiment, cap 302 without a vent assembly as shown in FIGS. 6A through 6E is placed in a mold and material for vent assembly 304 is formed over portions of upper surface 308 of cap 302 as well as the underside of cap 302 to produce cap 302 shown in FIGS. 3A and 3B. In one embodiment, injection molding is used to form vent assembly 304 over cap 302 as shown in FIGS. 3A and 3B. In one embodiment, a mold used to form vent assembly 304 includes a pin, or other cylindrical protrusion, to form material of vent assembly 308 that is located within vent orifice 314 as shown in FIGS. 4A-4F. The pin causes vent assembly 304 to be formed with a hollow cylindrical portion extending from upper portion 304A through vent orifice 314 to lower portion 304B. The hollow cylindrical portion of vent assembly 304 provides an opening through which gas within a container can escape through closure 302 prior to removing closure 302 from a container on which closure 302 has been placed after upper portion 304A has been peeled away from upper surface 308 of cap 302. Any type of molding operation or process that forms vent assembly 304 over cap 302 that forces material through vent retainer orifice 312 and vent orifice 314 (shown in FIGS. 6A-6E) can be used.

It should be noted that the openings in the cap can be shapes other than circular, such as rectangular, triangular, etc. The cross-sectional shape of the material of the vent assembly is substantially the same as the shape of the opening. It should also be noted that the material of the vent assembly extending through the openings of the cap can be hollow or solid.

In one embodiment, closure 302 is placed (i.e., screwed or threaded onto) on a container (not shown) after the container has been filled with a carbonated liquid. Shrink wrap, or other packaging material, can then be placed over the container and cap 302 to fix cap 302 onto container prior to removal of the wrap. A consumer removes the wrap, in one embodiment, by tearing the wrap along perforations located on the wrap. After the wrap has been removed, the consumer grips vent assembly 304 shown in FIGS. 4A-4E by gripping the portion of vent assembly having the plurality of ribs 304C and lifting away from upper surface 308 of cap 302. This causes upper portion 304A to separate from the cylindrical portion of vent assembly 304 material located in vent orifice 314 (shown in FIG. 6A-6E). Separation of upper portion 304A of vent assembly 304 from the cylindrical portion of vent assembly material located in vent orifice 314 allows the pressure inside the container to vent to the ambient air. After the pressure has been vented, cap 302 can be removed by unscrewing it from the container.

The foregoing Detailed Description is to be understood as being in every respect illustrative and exemplary, but not restrictive, and the scope of the inventive concept disclosed herein is not to be determined from the Detailed Description, but rather from the claims as interpreted according to the full breadth permitted by the patent laws. It is to be understood that the embodiments shown and described herein are only illustrative of the principles of the inventive concept and that various modifications may be implemented by those skilled in the art without departing from the scope and spirit of the inventive concept. Those skilled in the art could implement various other feature combinations without departing from the scope and spirit of the inventive concept.

The invention claimed is:

1. A closure comprising:

a cap comprising:

a circular top having a first opening and a second opening; and a cylindrical sidewall extending downward from a periphery of the circular top; and a vent assembly comprising:

a top portion located on a top surface of the circular top;

a bottom portion located on a bottom surface of the circular top;

a hollow connector located in the first opening and having a cavity bounded on one side by a cavity top surface that is substantially collinear with the top surface of the circular top, the hollow connector extending from the top portion to the bottom portion and connecting the top portion to the bottom portion; and a solid connector located in the second opening and connecting the top portion to the bottom portion.

2. The closure of claim 1, wherein the first opening is located in substantially a center of the circular top and the second opening is offset from the first opening.

3. The closure of claim 1, wherein the sidewall comprises threads located on an inner surface of the sidewall configured to engage complimentary threads of a beverage container.

4. The closure of claim 3, wherein the threads have a low angle pitch.

5. The closure of claim 3, wherein a material of the cap is sufficiently rigid for the threads engaged with the complimentary thread to withstand pressure generated from a carbonated beverage located in the beverage container.

6. The closure of claim 1, further comprising:

a circular seal located on the bottom surface of the circular top.

7. The closure of claim 6, wherein the vent assembly and circular seal are made of a flexible material and are over molded onto the cap.

8. The closure of claim 1, wherein the top portion of the vent assembly is elongated and has a circular end opposite an end of the top portion located over the second opening.

9. The closure of claim 1, wherein a material of the vent assembly is sufficiently rigid to withstand pressure generated from a carbonated beverage located in the beverage container.

10. A closure comprising:

a cap comprising a top surface, a bottom surface, and an opening extending through the cap from the top surface to the bottom surface; and a vent assembly comprising a top portion located adjacent to the top surface, a bottom portion located adjacent to the bottom surface, and a cylindrical connector located in the opening and having a cavity bounded on one side by a cavity top surface that is substantially collinear with the top surface of the cap, the cylindrical connecter extending from the top portion to the bottom portion and connecting the top portion to the bottom portion.

11. The closure of claim 10, wherein the vent assembly is made of a flexible material over molded onto the cap.

12. The closure of claim 10, wherein the top portion of the vent assembly is elongated and has a circular end opposite a rounded end of the top portion.

13. The closure of claim 10, wherein a material of the cap is sufficiently rigid for threads of the cap engaged with complimentary threads of an associated beverage container to withstand pressure generated from a carbonated beverage located in the beverage container.

14. The closure of claim 10, wherein a material of the vent assembly is sufficiently rigid to withstand pressure generated from a carbonated beverage located in an associated beverage container.

15. A vent assembly for a beverage container, the vent assembly comprising:

a first member located on an outer surface of a cap;

a second member located on an inner surface of the cap; and a cylindrical connecting member having a cylindrical cavity bounded on one side by a cavity top surface that is substantially collinear with the outer surface of the cap, the cylindrical connecting member extending from the first member to the second member and connecting the first member to the second member via a vent orifice of the cap.

16. The vent assembly of claim 15, wherein the vent assembly is made of a flexible material over molded onto the cap.

17. The vent assembly of claim 15, wherein the first member of the vent assembly is elongated and has a circular end opposite a rounded end of the first member.

18. The vent assembly of claim 15, wherein a material of the vent assembly is sufficiently rigid to withstand pressure generated from a carbonated beverage located in an associated beverage container.

19. The vent assembly of claim 15, wherein a material of the cap is sufficiently rigid for threads of the cap engaged with complimentary threads of a fluid holding portion of the beverage container to withstand pressure generated from a carbonated beverage located in the beverage container.

* * * * *